US009447634B2

(12) United States Patent
Williams et al.

(10) Patent No.: US 9,447,634 B2
(45) Date of Patent: Sep. 20, 2016

(54) WINDOW TREATMENT

(71) Applicant: Frame It Shutter Shades LLC, Phoenix, AZ (US)

(72) Inventors: Richard R. Williams, Gilbert, AZ (US); Scott M. Bray, Mesa, AZ (US); Tom Roth, Gilbert, AZ (US)

(73) Assignee: Frame It Shutter Shades LLC, Phoenix, AZ (US)

( * ) Notice: Subject to any disclaimer, the term of this patent is extended or adjusted under 35 U.S.C. 154(b) by 0 days.

(21) Appl. No.: 14/789,638

(22) Filed: Jul. 1, 2015

(65) Prior Publication Data

US 2016/0002970 A1 Jan. 7, 2016

Related U.S. Application Data

(60) Provisional application No. 62/019,773, filed on Jul. 1, 2014.

(51) Int. Cl.
*E06B 1/04* (2006.01)
*E06B 9/58* (2006.01)
*E06B 9/28* (2006.01)

(52) U.S. Cl.
CPC *E06B 9/582* (2013.01); *E06B 9/28* (2013.01)

(58) Field of Classification Search
CPC ..... E06B 1/62; E06B 2001/628; E06B 1/34; E06B 9/327; E04F 19/0486; E04F 19/064
See application file for complete search history.

(56) References Cited

U.S. PATENT DOCUMENTS

| | | | | |
|---|---|---|---|---|
| 5,226,466 | A * | 7/1993 | Coddens | E09B 9/264 160/107 |
| 8,109,052 | B2 * | 2/2012 | Rosende | E06B 1/6015 52/204.53 |
| 2006/0243396 | A1 * | 11/2006 | Liang | E06B 9/262 160/84.06 |
| 2009/0205272 | A1 * | 8/2009 | Rosende | E06B 1/02 52/215 |
| 2013/0048230 | A1 * | 2/2013 | Marocco | E06B 9/58 160/127 |
| 2013/0067835 | A1 * | 3/2013 | Chou | E06B 1/34 52/173.1 |

* cited by examiner

*Primary Examiner* — Brian Mattei
*Assistant Examiner* — Gisele Ford
(74) *Attorney, Agent, or Firm* — Schmeiser, Olsen & Watts LLP

(57) ABSTRACT

A window covering is provided. The window covering may include a frame mountable within a window return. The frame includes up to four frame members. The four frame members include a first side member having a first light stop, a second side member having a second light stop, a top member having a top light stop, and a bottom member having a bottom light stop. The top member may be coupled between top ends of the first side member and the second side member and the bottom member may be coupled between bottom ends of the first side member and the second side member to form a rectilinear shaped frame. A window covering may be coupled within the frame, wherein the light stops reduce a light gap between the window covering and the frame.

18 Claims, 10 Drawing Sheets

WINDOW TREATMENT

CROSS REFERENCE TO RELATED APPLICATION[S]

This application claims priority to U.S. Provisional Patent Application entitled "WINDOW TREATMENT," Ser. No. 62/019,773, filed Jul. 1, 2014, the disclosure of which is hereby incorporated entirely herein by reference.

BACKGROUND OF THE INVENTION

1. Technical Field

This invention relates generally to window treatments and more particularly to a frame for use with window coverings.

2. State of the Art

Windows are used in buildings to provide for the passage of light and for creating views into and out from a building for its occupants and passerbys. Windows, such as single or dual pane glass windows, can prevent unwanted debris and air circulation from outside the building. However, colorless and tinted glass windows, by themselves, often do not provide adequate control for light levels and view for privacy and comfort. As such, window coverings such as shades, shutters, and blinds are also used in addition to windows to help building occupants control light levels and view with respect to the window. However, a physical gap between the window and at least a portion of the window treatment can permit light to enter through the physical gap causing a light gap. A light gap can be a nuisance or problem, to some degree, among various window treatments including shades, shutters, and blinds.

Accordingly, there is a need in the field of window treatments for a frame that can reduce or eliminate a light gap along with other advantages such a frame provides.

DISCLOSURE OF THE INVENTION

The present invention relates to a frame for a window, wherein a window covering may be attached to the frame. The frame may include a z-shape and may be referred to as a z-frame, wherein the z-shape frame includes a light stop to minimize or eliminate a light gap that is present with most window coverings.

An embodiment includes a window covering that comprises a frame mountable within a window return, the frame comprising; a first side member having a first light stop; a second side member having a second light stop, the second side member substantially parallel to the first side member; a top member having a top light stop; a bottom member having a bottom light stop, the bottom member substantially parallel to the top member, wherein the top member is coupled between the first side member and the second side member at top ends of the first side member and the second side member, and the bottom member is coupled between the first side member and the second side member at bottom ends of the first side member and the second side member to form a rectilinear shaped frame; and a window covering coupled within the frame, wherein the light stops reduce a light gap between the window covering and the frame.

Another embodiment includes a frame mountable within a window return. The frame comprises a first side member having a front piece, a first light stop and a connecting member coupled between the front piece and the first light stop to form a z-shape; a second side member having a front piece, a second light stop and a connecting member coupled between the front piece and the second light stop to form a z-shape; a top member having a front piece, a top light stop and a connecting member coupled between the front piece and the top light stop to form a z-shape; and a bottom member having a front piece, a bottom light stop and a connecting member coupled between the front piece and the bottom light stop to form a z-shape, wherein the first side member, the second side member, the top member and the bottom member are coupled together in a rectilinear shape, and wherein the frame is configured to receive a window covering within the frame.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
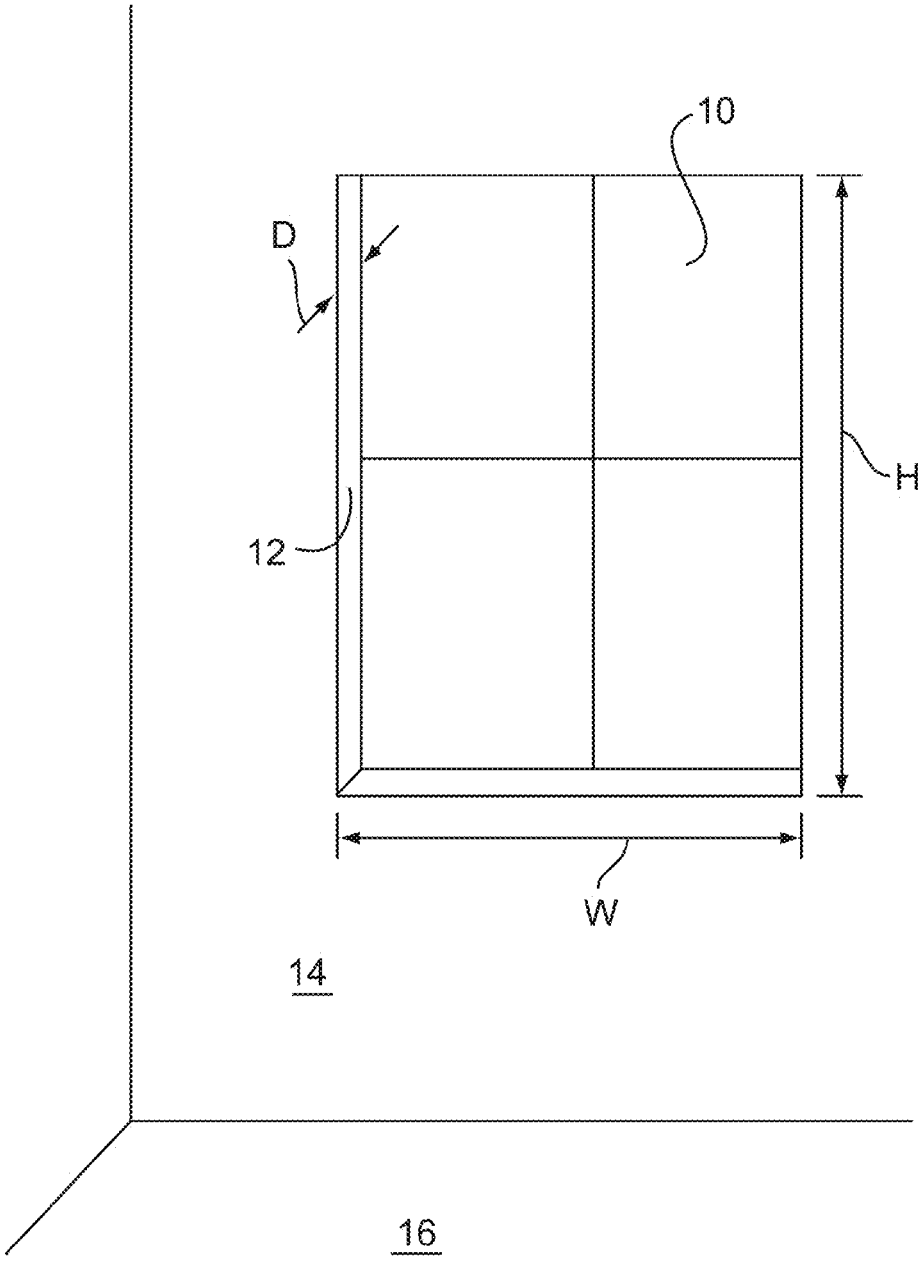
FIG. 1 is a perspective view of a window in a wall.
Figure 2:
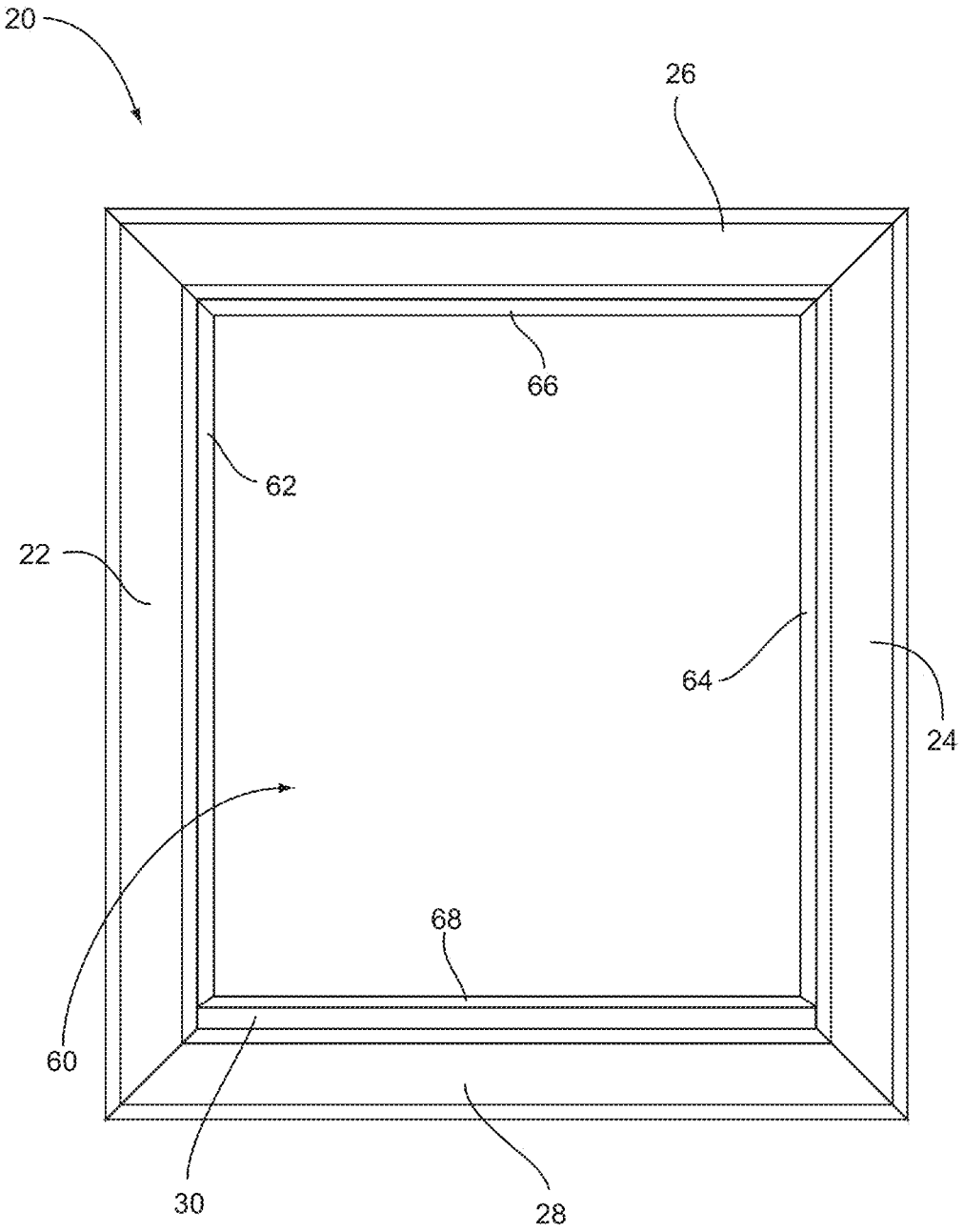
FIG. 2 is a front view of a frame mountable within a window return in accordance with embodiments of the present invention.
Figure 3:
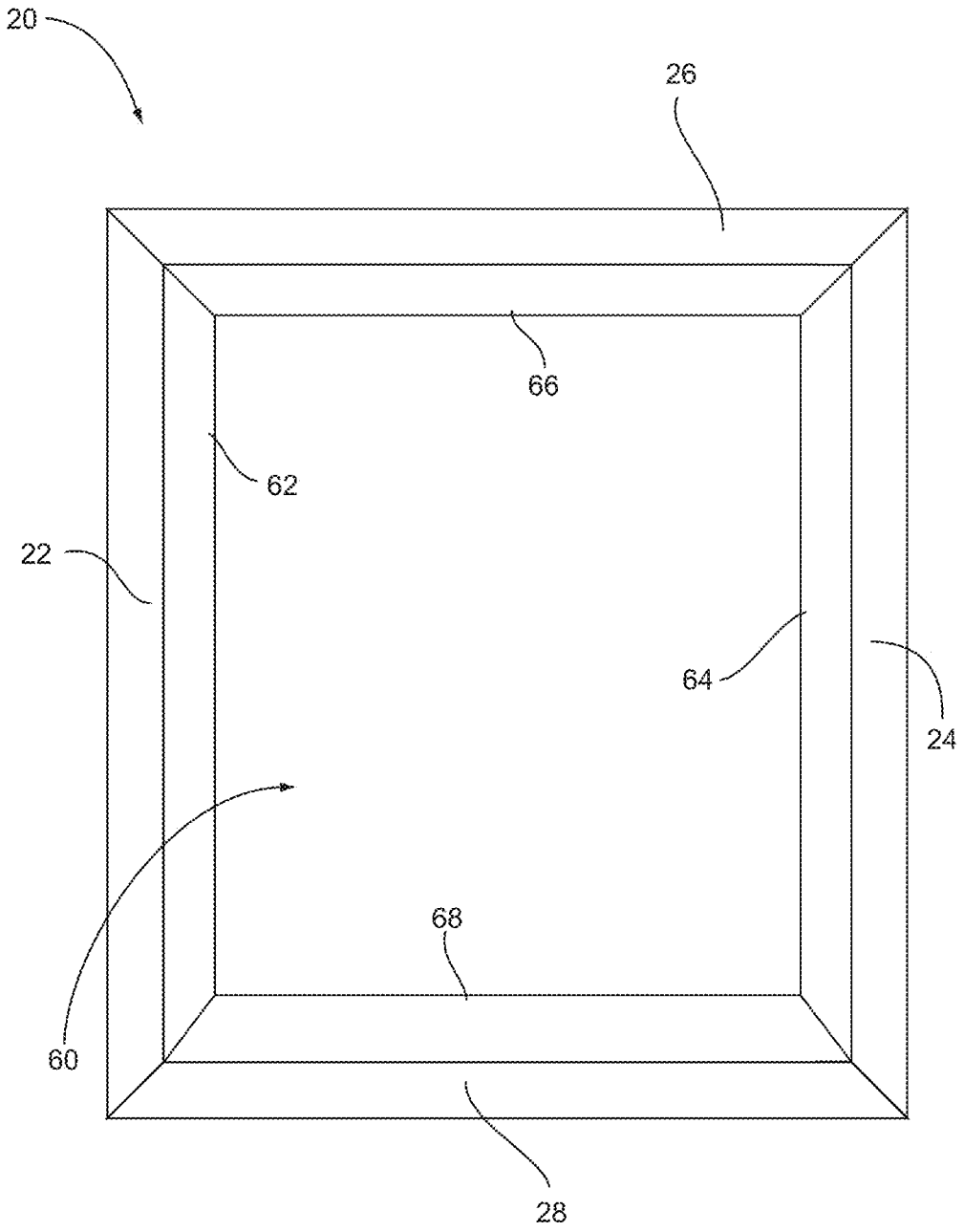
FIG. 3 is a rear view of a frame mountable within a window return in accordance with embodiments of the present invention.
Figure 4:
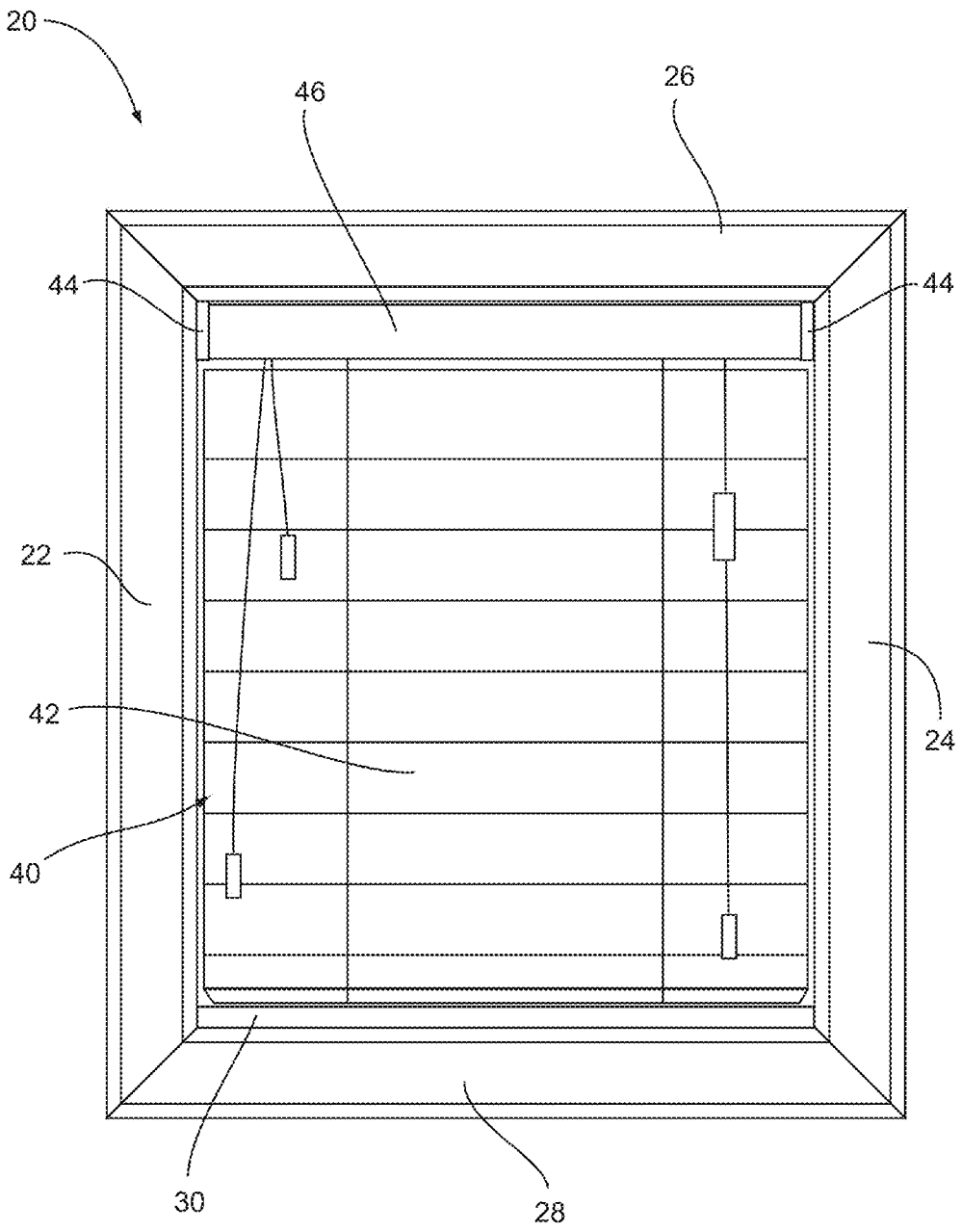
FIG. 4 is front view of a frame mountable within a window return and a window covering coupled to the frame, with the window covering in a light blocking configuration.
Figure 5:
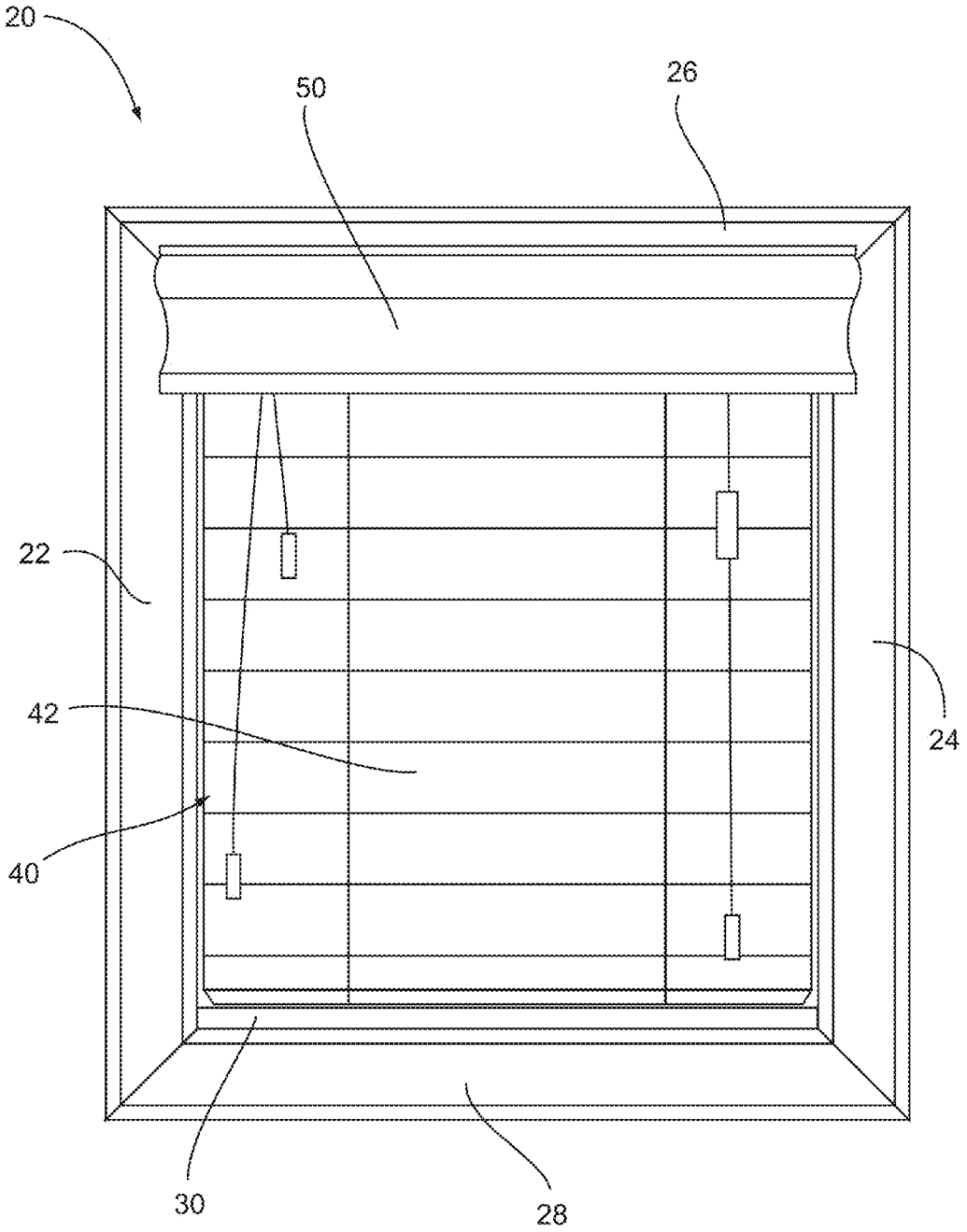
FIG. 5 is front view of a frame mountable within a window return and a window covering coupled to the frame, with the window covering in a light blocking configuration with a valence to cover a headrail of the window covering.
Figure 6:
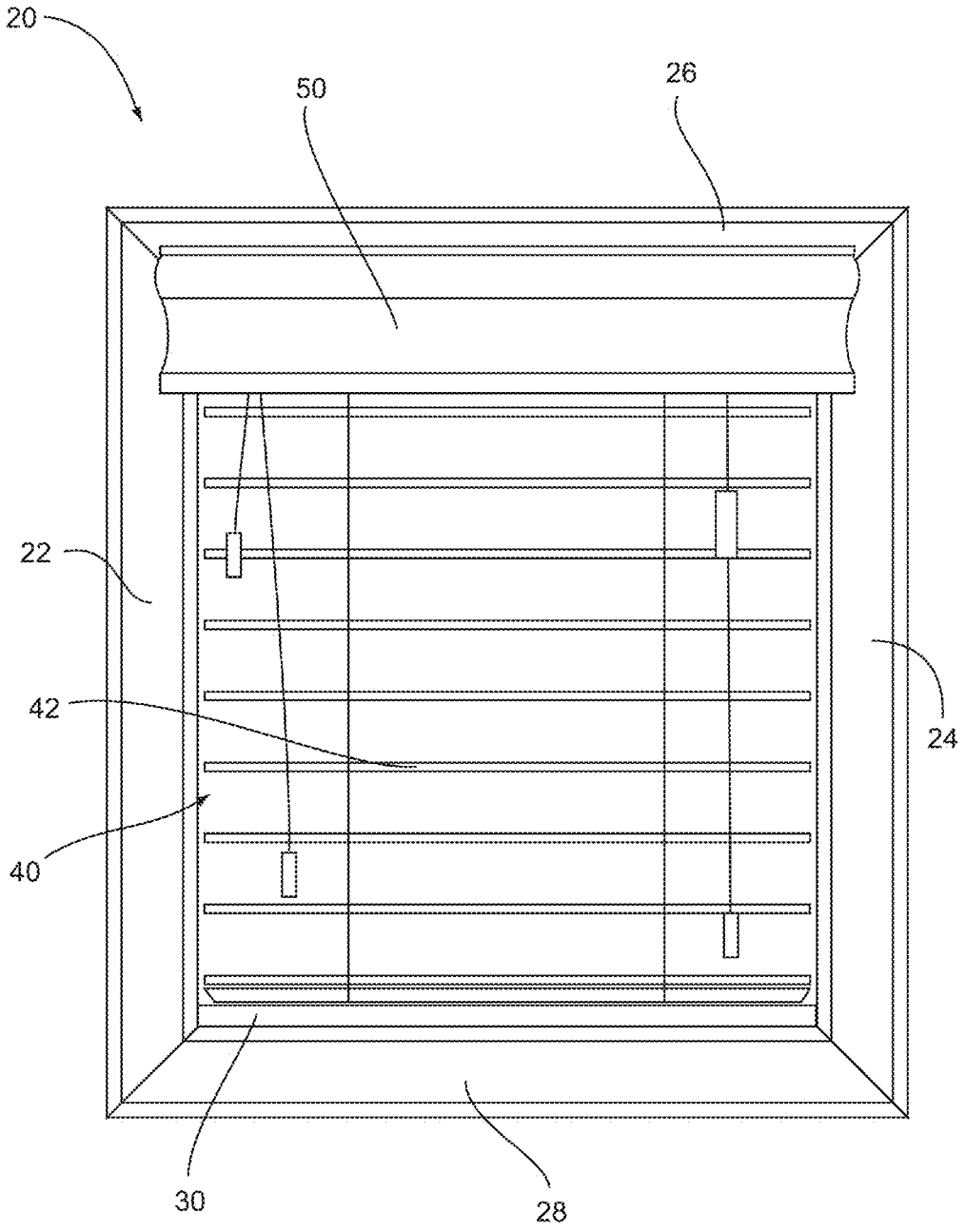
FIG. 6 is a front view of a frame mountable within a window return and a window covering coupled to the frame, with the window covering in a light entering configuration.
Figure 7:
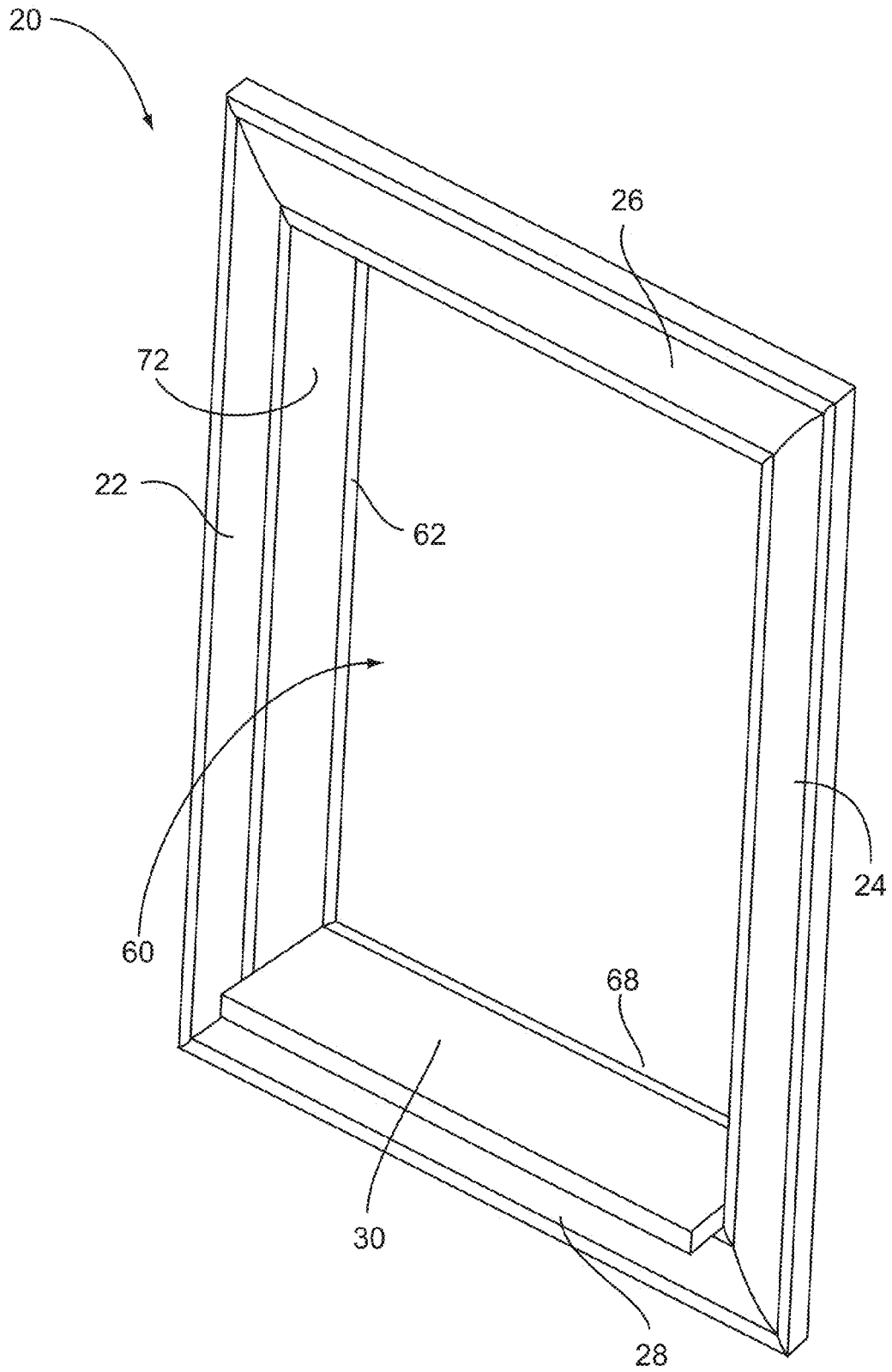
FIG. 7 is a perspective view of a frame mountable within a window return and a window covering coupled to the frame, with the window covering in a light blocking configuration.

As discussed above, embodiments of the present invention relate to a frame for a window, wherein a window covering may be attached to the frame. The frame may include a z-shape and may be referred to as a z-frame, wherein the z-shape frame includes a light stop to minimize or eliminate a light gap that is present with most window coverings.

A light gap problem can still persist, to some degree, among various window treatments including shades, shutters, and blinds. A light gap can be present with both wood window returns and window casings as well as for drywall window returns and window casings. As used herein, window returns refer to the recess, depth, or offset that exists between a surface of the wall in which the window is formed and the window itself. As used herein, a window casing refers to the trim or molding that extends along an interface between the wall and the window return.

There are various types of window returns. One is a bench built window trim that includes a wood window casing and wood window return, which traditionally require a finish carpenter or craftsman to come on-site to custom install the wood window casing and window return based on the specific dimensions of the window, and to account for any size discrepancies in the dimensions of the window openings, caused for example, by rough framing that is out of square. The result can be an aesthetically pleasing window casing and window frame that is square but can be time intensive resulting in a high cost for the labor of the finish carpenter or craftsman.

Another type of a window return is a drywall window return. A drywall window return can be used on windows where no trim will be installed, such as for lower-priced builder-grade homes. Wood trim is relatively expensive to purchase and install, so many builders choose the drywall-return method to save on construction costs. In some cases, a windowsill will be installed while the sides and top are finished in drywall. Windowsills are installed because drywall can respond poorly to moisture coming through the window, such as through window screens. Use of drywall returns is a common practice, especially in sunbelt states where moisture is low, such as in Nevada, California, Arizona, New Mexico, and Texas.

The method and device for window treatments discussed below, while applicable to wood window returns, drywall window returns, or any other types of window returns, for convenience of description are principally discussed, without limitation, with respect to drywall window returns.

There has been a long felt need to reduce a problem of light gaps, especially with light gaps for blinds. The following are three examples of how people conventionally reduce a light gap for blinds. First, the light gap with blinds can be reduced by putting panels, such as a drape, over the window in conjunction with the blinds. A drape can be stationery and hide a light gap almost completely, while the blinds can be operable to open and close allowing a greater or lesser amount of light to enter through the window. This solution is usually a more cost effective solution than operable drapes. Second, use light filtering blinds instead of room darkening products. Light filtering might offer a bit less darkness than opaque blinds so they create a less noticeable gap. Third, mount the blinds externally to the window return on a surface of the wall in which the window is formed. If the blind covers a greater area, such as molding around the window, there is less opportunity for the light to pass around the blind, and less of a light gap is created.

Embodiments of the present invention will be discuss and shown in use with blinds mounted with a frame, however, it will be understood that frames in accordance with embodiments may be used with any other type of window covering. Referring to the drawings, FIG. 1 shows a perspective view of a window 10 formed in a wall above a floor 16 or ground level where a width W of the window extends horizontally, a height H of the window extends vertically, and a depth D of the window or window return extends as a depth from the wall 14 toward the window 10.

FIGS. 2-7 depict an embodiment of a frame 20 for use with window coverings. The frame 20 may include a first side member 22, a second side member 24 a top member 26 and a bottom member 28. Frame 20 may further include a sill 30 coupled to a top side of bottom member 28. Frame 20 further comprises a first side light stop 62, a second side light stop 64, a top light stop 66, and a bottom light stop 68, wherein the light stops 62, 64, 66 and 68 extend from the side members 22 and 24, the top member 26 and bottom member 28 in an inner direction. Assembled, frame 20 is in a rectilinear shape, wherein the first side member 22 and second side member 24 are substantially parallel, wherein top member 26 is coupled between first side member 22 and second side member 24 at top ends of first side member 22 and second side member 24. Additionally, bottom member 38 is coupled between first side member 22 and second side member 24 at bottom ends of first side member 22 and second side member 24, wherein top member 26 and bottom member 28 are substantially parallel with each other. When frame members 22, 24, 26 and 28 are coupled together in this rectilinear fashion, an opening 60 is define between the side members 22, 24, 26 and 28. Light stops 62, 64, 66 and 68 each extend from its respective frame member 22, 24, 26 and 28 and into opening 60.

Figure 8:
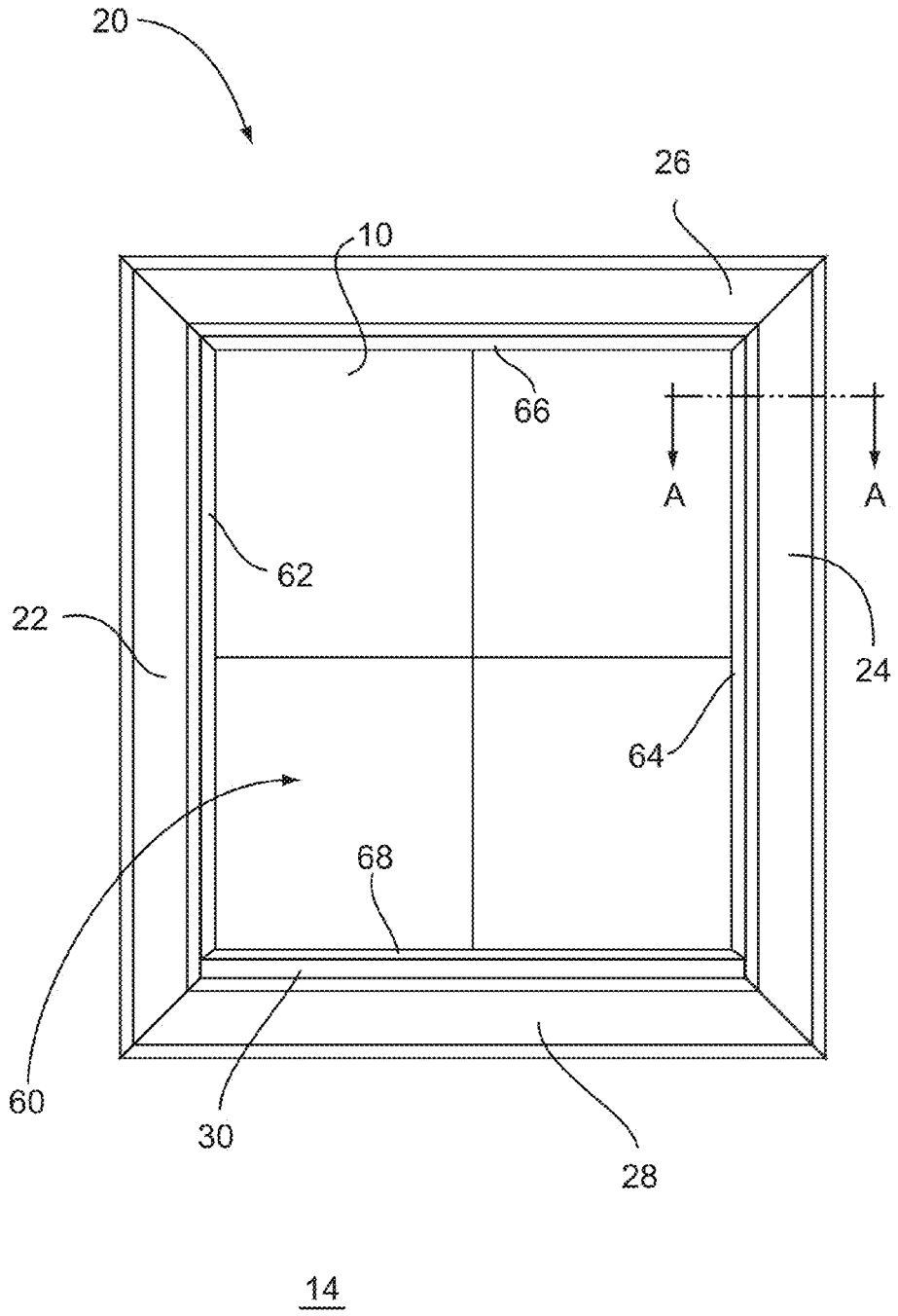
FIG. 8 is a front view of a frame mounted to window in accordance with embodiments of the present invention.

Frame 20 may be mounted within a window 10 in a wall 14, as shown in FIG. 8. Frame 20 may be disposed next to wall 14 at the window return, but slightly offset from the wall for visual clarity. Once frame 20 is mounted into a window 10, a window covering 40 may then be mounted to frame 20. For example, and without limitation, window covering 40 may be blinds having louvers 42 and a headrail 46. Brackets 44 may be mounted directly to frame 20 and then headrail 46 may be mounted within brackets 44 as is typical with many blinds. Once the blinds 40 are installed a user may then install a valence 50 that covers the headrail 46 to hide the hardware and improve the aesthetics of the window covering 40.

Figure 9A:
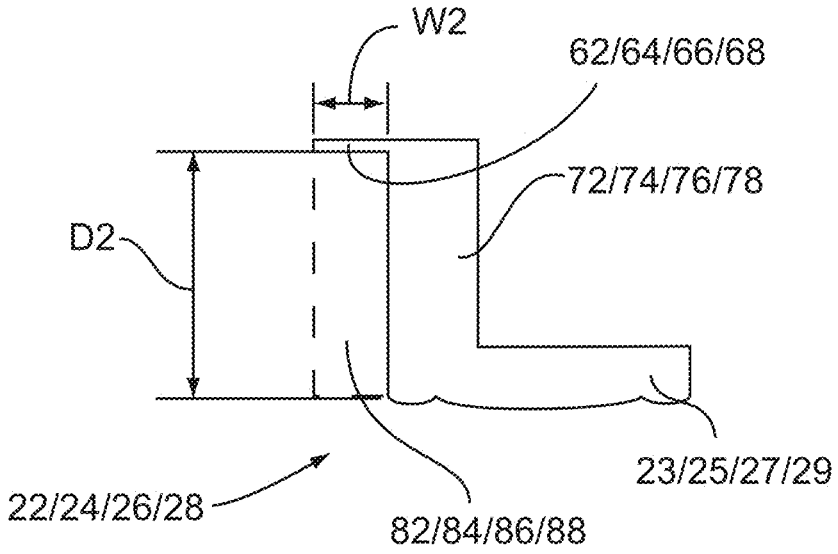
FIG. 9A is a section view of a second side member of a frame taken along line 9-9 of FIG. 8.
Figure 9B:
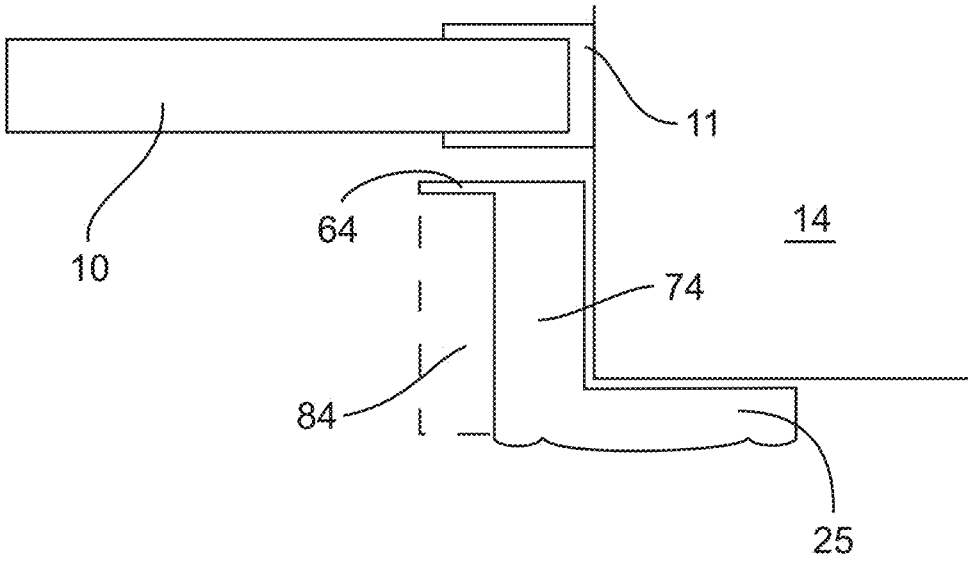
FIG. 9B is a section view of a second side member mounted within a window return taken along line 9-9 of FIG. 8.

Referring further to the drawings, FIGS. 9A and 9B depict a cross-section view of second side member 24 installed on a window, the cross-section taken along line 9-9 of FIG. 8. The discussion with regard to FIG. 9A is directed to second side member 24, however, it will be understood that each of the frame members 22, 24, 26 and 28 are similar and the discussion with regard to components of second frame members 24 also similarly applies to first side member 22, top member 24 and bottom member 26. FIG. 9A shows first side member 22, second side member 24, top member 26 or bottom member 28 as having a z-shape. Frame members 22, 24, 26 and 28 comprises a front piece 23, 25, 27 and 29; a connecting member 72, 74, 76 and 78; and a light stop 62, 64, 66 and 68 wherein connecting member 72, 74, 76 and 78 is coupled between front piece 23, 25, 26 and 28 and light stop 62, 64, 66 and 68 to form a z-shape with front piece 22, 24, 26 and 28 and light stop 62, 64, 66 and 68 extending in generally parallel planes. The frame members 22, 24, 26 and 28 may all have a z-shape, when coupled together to form frame 20, opening 60 extends through opening defined between light stops 62, 64, 66 and 68. Light stops 62, 64, 66 and 68 form a step member that is offset from front pieces 23, 25, 27 and 29 of frame members 22, 24, 26 and 28.

Light stop 62, 64, 66 and 68 may include a width W2 and a thickness. In some embodiments, width W2 extends from an inner surface of connecting member 72, 74, 76 and 78 extending to an end of light stop 62, 64, 66 and 68 and may be within a range of 0.5 inch to 1.5 inch; within a range of 0.5 inch to 1 inch; within a range of 0.75 inch to 1 inch; or approximately 0.75 inch. In some embodiments, the thickness of light stop 62, 64, 66 and 68; may be within a range of 0.125 inch to 0.75 inch; within 0.125 inch to 0.5 inch; within 0.125 inch to 0.25 inch; or approximately 0.125 inch.

Frame member 22, 24, 26 and 28 may include a depth D2 extending from a front surface of front piece 23, 25, 27 and 29 to light stop 62, 64, 66 and 68, D2 extending along connecting member 72, 74, 76 and 78. In some embodiments, depth D2 may be within a range of 1.0 inch to 2.0 inch; within a range of 1.25 inch to 2.0 inch; within a range of 1.5 inch to 2.0 inch; within a range of 1.75 inch to 2.0 inch; or approximately 1.75 inch.

Connecting members 72, 74, 76 and 78 define an area that may be utilized to install window coverings. Connecting members 72, 74, 76 and 78 can be coupled to one or more surfaces of wall 14 using chemical or mechanical fasteners, such as glue, nails, screws, or other suitable attachment devices. In an embodiment, a screw extends in a transverse direction through connecting member 72, 74, 76 and 78 of frame member 22, 24, 26 and 28 to fixedly attach frame member 22, 24, 26 and 28 to the window return. Connecting members 72, 74, 76 and 78 also creates a space 82, 84, 86 and 88 with regard to each frame member 22, 24, 26 and 28. Space 82, 84, 86 and 88 is configured to receive a window covering 40, such as the blinds or blind slats that would typically be mounted within the window return. Space 82, 84, 86 and 88 may comprise depth D2 and width W2, which dimensions are sufficient to maintain the window covering 40 within space 82, 84, 86 and 88 when window covering 40 is in a position to block light. Space 82, 84, 86 and 88 maintaining window covering 40 within it works in conjunction with light stop 62, 64, 66 and 68 in order to reduce light that emits through window covering 40. Accordingly, by positioning window covering 40 within space 82, 84, 86 and 88 and within the window return, light entering perpendicular to the glass of a window in the view shown in FIG. 9B will either be blocked by light stop 62, 64, 66 and 68 of the frame member 22, 24, 26 and 28 or by window covering 40, such that the overlap between the window covering 40 and light stop 62, 64, 66 and 68 limit, reduce or prevent light from passing through the window treatment comprising window covering 40 and frame 20, thereby reducing or preventing a light gap. As such, a width W2 may be greater than an offset or spacing between an edge of window covering 40 and the inside surface of connecting piece 72, 74, 76 and 78.

Advantageously, by having light stop 62, 64, 66 and 68 disposed closer to window glass 10 than window covering 40, window covering can be more easily removed and repaired or adjusted than embodiments where window covering 40 is closer to glass 10 than light stop 62, 64, 66 and 68. When window covering 40, such as blinds, is closer to glass 10 than light stop 62, 64, 66 and 68, the entire frame must be removed from the window in order to repair or fix the blinds which adds extra effort, time, and expense to repairs.

To the contrary, use of blinds and a z-frame for a window treatment does not include a style disposed between the blind slats and the connecting piece of the z-frame. Instead, window treatment in accordance with embodiments can comprise blind slats disposed within the slat space of the blind z-frame without a style or other intervening member disposed between the blind slat and the connecting piece of the z-frame. As such, the depth of the blind slats (unlike a depth of the shutter louvers) is limited by the depth of the slat space so that the slat space is substantially equal to, or greater than, a depth of the blind slats.

Advantageously, by making a depth of the slat space substantially equal to, or less than, a depth of the blind slats, the slats of the blinds will be positioned closely to the back piece (or foot portion) of the z-frame to block passage of light and reduce a light gap and restrict unwanted visibility around an edge of the blind slats. The back piece of the z-frame will be closer to the blind slats than a window sash, and thus provide greater light gap reduction than for a blind without the back piece. Additionally, blinds can be mounted with the z-frame within a window return and reduce the unwanted light gap without being limited or constrained by the backspace of the window return as would be the case with relying on a window sash to prevent or minimize a light gap for blinds mounted within a window return. Furthermore, a window treatment comprising blinds disposed within a z-frame allows for an advantage of self-leveling or squaring a window return by allowing for a gap between a outside surface of the back piece and an outside surface of the connecting piece to be offset from the wall along a height (y-direction) or width (x-direction) of the z-frame to account for uneven measurements along the height or width of the window return. As such, a window treatment comprising a z-frame with blind slats disposed within a slat space can provide at least the dual benefits of squaring a window return and providing light gap reduction by the back piece of the z-frame without relying on the presence and position of a window sash.

In embodiments frame members 22, 24, 26 and 28 be formed of different integral piece of natural or synthetic material such as lumber, engineered wood product, plastics, resins, or other suitable materials. Advantageously, a portion of the frame members 22, 24, 26 and 28 may be configured to receive mechanical fasteners, such as screws, can be formed with sufficient structural strength to resist the fasteners being stripped. In some embodiments, natural wood products are preferred to engineered wood products, such a particle board, to prevent screws from stripping, such as from the back piece. Further frame members 22, 24, 26 and 28 may include multiple pieces or components coupled together to form frame members 22, 24, 26 and 28 to have a size and shape as described above. In other embodiments, frame members 22, 24, 26 and 28 may be formed as integral pieces.

While the frame 20 shown in FIGS. 2-9 are each shown with z-shaped cross-sectional shapes, in light of the discussion and teaching herein, a person having ordinary skill in the art would understand that a pop-in frame could similarly be made as an L-shaped face mount frame. The face mount frame could have a connecting piece and a back piece joined to form a space comprising dimensions as described above with respect to space 82, 84, 86 and 88. Advantageously, the L-shaped face mount frame could be used for older homes and homes built in geographies in which a window does not have the depth to accommodate the frame 20 as discussed above. While frames 20 for blinds are often referred to herein, for convenience, as z-frames or pop in z-frames for blinds, this non-limiting use can also include l-shaped or face mount frame pop-in frames for blinds.

Figure 10:
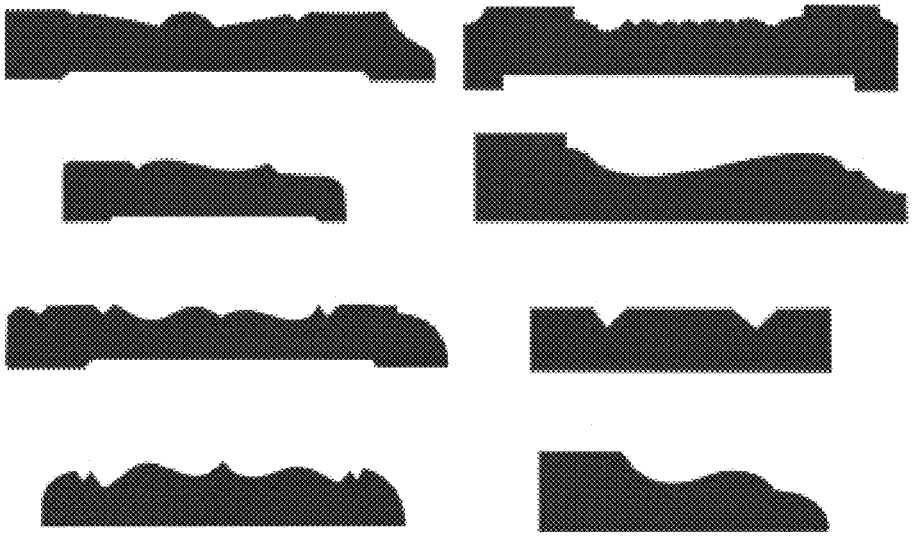
FIG. 10 is a view of various designs of a front piece of frame members of a frame in accordance with embodiments of the present invention.

The front side of the front piece 23, 25, 27 and 29 of the frame members 22, 24, 26 and 28 respectively can be tooled or routed to include one of a plurality of standard or custom design. While any custom or standard design can be used as part of front side of the front piece 23, 25, 27 and 29, FIG. 10 shows non-limiting exemplary designs that can be used.

In some embodiments, a window treatment comprising window covering 40 mounted with frame 20 can be provided as a kit comprising lengths of frame members 22, 24, 26 and 28, such as four pieces of desired distances to match particular or standard window sizes with fasteners, such as Hoffman fasteners or other suitable fasteners, for attaching the z-frame pieces to form a single modular unit (before or after transport), and blinds sized to fit within the z-frame as described above. Such a kit can be compact for convenient shipping and transport.

In other embodiments, window covering 40 may include, without limitation, wood blinds, faux wood blinds, rolling shades, honeycomb shades, cellular shades, mini-blinds, or other suitable window treatments. In other embodiments, horizontal movement can also be accommodated, such as without limitation, vertical blinds and other suitable window treatments.

A method of installing frame 20 can include a customer measuring a size of his window, placing an order for window covering 40 and frame 20 for window covering 40, receiving by mail or other delivery a box comprising window covering 40, linear lengths of frame members 22, 24, 26 and 28 of an unassembled frame 20 for window covering 40. The method may include assembling frame 20 with frame member 22, 24, 26 and 28 as described above and mounting frame 20 within a window. The method may then include mounting window covering 40 within frame 20.

The kit may include frame pieces that are made and sized at large volumes, or are mass-produced. Thus, orders for standard window sizes can be readily and efficiently filled while providing an improved window treatment that can have an appearance of a custom or individualized assembly.

Orders received for a frame 20 may be sized according to any suitable methodology, and in an embodiment, an overall dimension for the blinds shipped can be determined by taking a width of the window in inches an subtracting a predetermined length, such as 2.5 inches from the window width to account for frame 10, and then adding an additional predetermined length, such as ⅛ inch to window covering 40 width to account for a tighter tolerance that exists between frame 20 and window covering 40 than exists with respect to a window opening and window covering 40.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A window covering assembly comprising:

a frame mountable within a window return, the frame comprising;

a first side member having a first light stop;

a second side member having a second light stop, the second side member substantially parallel to the first side member;

a top member having a top light stop;

a bottom member having a bottom light stop, the bottom member substantially parallel to the top member, wherein the top member is coupled between the first side member and the second side member at top ends of the first side member and the second side member, and the bottom member is coupled between the first side member and the second side member at bottom ends of the first side member and the second side member to form a rectilinear shaped frame;

a window covering coupled within the frame, wherein the light stops are located between a window and the window covering to reduce a light gap between the window covering and the frame; and wherein the first side member comprises a connecting member and a front piece, wherein the connecting member is between the front piece and the first light stop to form a z-shape.

2. The window covering assembly of claim 1, wherein the second side member comprises a connecting member and a front piece, wherein the connecting member is coupled between the front piece and the second light stop to form a z-shape.

3. The window covering assembly of claim 2, wherein the top member comprises a connecting member and a front piece, wherein the connecting member is coupled between the front piece and the top light stop to form a z-shape.

4. The window covering assembly of claim 3, wherein the bottom member comprises a connecting member and a front piece, wherein the connecting member is coupled between the front piece and the bottom light stop to form a z-shape.

5. The window covering assembly of claim 4, wherein the width of each light stop is within a range of 0.5 inch to 1.5 inch.

6. The window covering assembly of claim 4, wherein the width of each light stop is within a range of 0.5 inch to 1 inch.

7. The window covering assembly of claim 4, wherein the width of each light stop is within a range of 0.75 inch to 1 inch.

8. The window covering assembly of claim 4, wherein the width of each light stop is approximately 0.75 inch.

9. The window covering assembly of claim 4, wherein the thickness of each light stop is within a range of 0.125 inch to 0.75 inch.

10. The window covering assembly of claim 4, wherein the thickness of each light stop is within 0.125 inch to 0.5 inch.

11. The window covering assembly of claim 4, wherein the thickness of each light stop is within 0.125 inch to 0.25 inch.

12. The window covering assembly of claim 4, wherein the thickness of each light stop is approximately 0.125 inch.

13. A frame mountable within a window return, the frame comprising:

a first side member having a front piece, a first light stop and a connecting member coupled between the front piece and the first light stop to form a z-shape;

a second side member having a front piece, a second light stop and a connecting member coupled between the front piece and the second light stop to form a z-shape;

a top member having a front piece, a top light stop and a connecting member coupled between the front piece and the top light stop to form a z-shape; and a bottom member having a front piece, a bottom light stop and a connecting member coupled between the front piece and the bottom light stop to form a z-shape, wherein the first side member, the second side member, the top member and the bottom member are coupled together in a rectilinear shape, wherein the frame is configured to receive a window covering within the frame, wherein the light stops are located between a window and the window covering to reduce a light gap between the window covering and the frame.

14. The frame of claim 13, wherein the first side member, the second side member, the top member and the bottom member each comprise a space having a depth extending from a front surface of the front piece to the light stop and a width extending from an inner surface of the connecting member to the end of the light stop.

15. The frame of claim 14, wherein the space of each of the first side member, the second side member, the top member and the bottom member form a perimeter space to receive a window covering within the perimeter space.

16. The method of claim 15, wherein the depth of each space is within a range of 1.0 inch to 2.0 inch.

17. The method of claim 15, wherein the depth of each space is approximately 1.75 inch.

18. The frame of claim 15, wherein a window covering is mounted to the connecting member of the top member.

* * * * *